US008065948B1

(12) United States Patent
Baptista et al.

(10) Patent No.: US 8,065,948 B1
(45) Date of Patent: Nov. 29, 2011

(54) DEVICE TO CLOSE THE GUN SLIT OR OPENING

(75) Inventors: Daniel Baptista, Sorbiers (FR); Stephane Leveque, Plaisir (FR); Michel Masson, Le Coteau (FR); Xavier Poirmeur, Guyancourt (FR)

(73) Assignee: Nexter Systems, Roanne (FR)

( * ) Notice: Subject to any disclaimer, the term of this patent is extended or adjusted under 35 U.S.C. 154(b) by 225 days.

(21) Appl. No.: 12/292,668

(22) Filed: Nov. 24, 2008

(30) Foreign Application Priority Data

Dec. 10, 2007 (FR) ..... 07.08566

(51) Int. Cl.
*F41H 5/26* (2006.01)

(52) U.S. Cl. ..... 89/36.14; 89/37.01

(58) Field of Classification Search ..... 89/36.14, 89/36.13, 36.15, 37.01, 37.21, 38, 40.03
See application file for complete search history.

(56) References Cited

U.S. PATENT DOCUMENTS

| | | | | | |
|---|---|---|---|---|---|
| 1,276,444 | A | * | 8/1918 | Taylor | 89/40.03 |
| 2,211,491 | A | * | 8/1940 | Brooke | 160/40 |
| 2,286,341 | A | * | 6/1942 | Burnelli | 89/37.16 |
| 2,457,240 | A | * | 12/1948 | Jorgensen | 89/36.14 |
| 2,573,434 | A | * | 10/1951 | Graham | 89/1.804 |
| 2,897,888 | A | * | 8/1959 | Dragonuk | 160/99 |
| 3,008,380 | A | * | 11/1961 | Cowley | 89/37.16 |
| 3,453,929 | A | * | 7/1969 | Betzold et al. | 89/36.14 |
| 3,710,681 | A | * | 1/1973 | Koontz | 89/36.14 |
| 3,742,813 | A | * | 7/1973 | Kongelbeck | 89/1.807 |
| 4,352,315 | A | * | 10/1982 | Ingestrand | 89/36.14 |
| 4,635,529 | A | * | 1/1987 | Tassie | 89/36.14 |
| 4,979,702 | A | * | 12/1990 | Franklin | 244/129.4 |
| 5,756,921 | A | * | 5/1998 | Dacko et al. | 89/36.02 |

FOREIGN PATENT DOCUMENTS

| | | | |
|---|---|---|---|
| DE | 59 668 | C | 11/1891 |
| DE | 21 28 703 | A | 1/1973 |
| FR | 1 022 540 | A | 3/1953 |
| FR | 1 485 274 | A | 6/1967 |
| FR | 2 371 664 | A1 | 6/1978 |
| GB | 555283 | A | 7/1943 |

* cited by examiner

*Primary Examiner* — Michelle Clement
(74) *Attorney, Agent, or Firm* — Oliff & Berridge, PLC

(57) ABSTRACT

A protection device to close the gun slit (or opening) of a mount, such gun slit delimited by two lateral flanges and two end flanges and in which pivots or moves a mobile organ carrying a mobile wall positioned between the exterior and interior of the mount, device which comprises at least one flexible bellows integral on one side with an end flange of the gun slit and on the other with the mobile organ (3), such device wherein the bellows and wall delimit an intermediate chamber that is linked to the internal space (10) of the mount, such space being pressurized by pressurization means.

10 Claims, 6 Drawing Sheets

DEVICE TO CLOSE THE GUN SLIT OR OPENING

BACKGROUND OF THE INVENTION

1. Field of the Invention

The technical scope of the invention is that of protection devices to close the gun slit (or opening) of a mount.

2. Description of the Related Art

A mount is classically designed in which there is a mobile organ that extends between an internal part of the mount and the exterior through a gun slit (or opening).

When a weapon system or turret, for example, is defined for an armoured vehicle, a gun slit must be provided to enable the passage of the gun barrel. This gun slit must enable to barrel to move, generally a pivotal movement to enable it to be positioned in elevation with respect to the turret.

The gun slit is an opening that is substantially rectangular and is delimited by two lateral flanges and two end flanges. The dimensions of the gun slit are chosen according to the clearance required for the gun barrel.

It is, however, more often than not necessary for sealing to be provided for the gun slit. In fact, any water run-off from the exterior must be prevented from entering the interior of the mount. Any projections of mud or gravel likely to deteriorate the gun's positioning capacity must also be prevented.

Another major problem occurs when the vehicle or weapon system is obliged to circulate through a contaminated environment (be it nuclear, bacteriological, or chemically, such environment being commonly designed "NBC").

It this case it is vital to prevent the passage of any contaminated materials into the vehicle or turret. This protection must not be such, however, as to prevent the weapon from pivoting and must continue to be effective during operational use.

It is also preferable for the decontamination of the terrain to be enabled, and thus any passage of liquid from the exterior to the interior of the vehicle to be prevented.

It is known to use flexible bellows integral with both the gun barrel and the flanges of the gun slit. However, these devices can not be adapted to all forms of gun slit encountered on military vehicles, and namely when the clearance angles are high (for example over 45°).

SUMMARY OF THE INVENTION

The aim of the invention is to propose a protection device that overcomes such problems.

Thus, the protection device according to the invention enables NBC sealing to be provided, even when the relative angular displacements of the barrel with respect to the gun slit are substantial.

The device according to the invention maintains this level of tightness during maneuvers on contaminated terrain, without any restriction of the gun's movements. The level of tightness is also maintained during decontamination operations on the terrain.

Thus, the invention relates to a protection device to close the gun slit (or opening) of a mount, such gun slit delimited by two lateral flanges and two end flanges and in which pivots or moves a mobile organ carrying a mobile wall positioned between the exterior and interior of the mount, device which comprises at least one flexible bellows integral on one side with an end flange of the gun slit and on the other with the mobile organ, such device wherein the bellows and wall delimit an intermediate chamber that is linked to the internal space of the mount, such space being pressurised by pressurization means.

According to a particular embodiment, the flexible bellows incorporates two undulated layers integral with one another by the peaks of their undulations so as to delimit transversal splines between the two layers.

The bellows may furthermore incorporate rods integral with its lower layer, positioned as closely as possible to the mobile wall, such rods positioned at the peaks of this layer that are closest to the mobile wall and circulating in guiding grooves arranged on the edges of the gun slit.

The upper layer can be of a width that is greater than that of the lower layer, and can rub against the lateral flanges of the gun slit when the organ is being displaced.

The lateral flanges of the gun slit will each advantageously carry a gutter positioned between the upper layer and the guiding groove, such gutter being linked to means to evacuate the run-off water.

The intermediate chamber may be linked to the internal space of the mount by means of a manifold incorporating at least one baffle to prevent the run-off water passing from the intermediate chamber to the internal space.

The protection device may also incorporate means to ensure sealing between the mobile organ and the lateral flanges of the gun slit, such means incorporating lateral shims integral with the organ and positioned between the latter and each of the lateral flanges.

The shims may have a profile that cooperates with the guiding groove.

BRIEF DESCRIPTION OF THE DRAWINGS

The invention will become more apparent from the following description of a particular embodiment, such description being made with reference to the appended drawings, in which.

DESCRIPTION OF THE PREFERRED EMBODIMENTS

Figure 1:
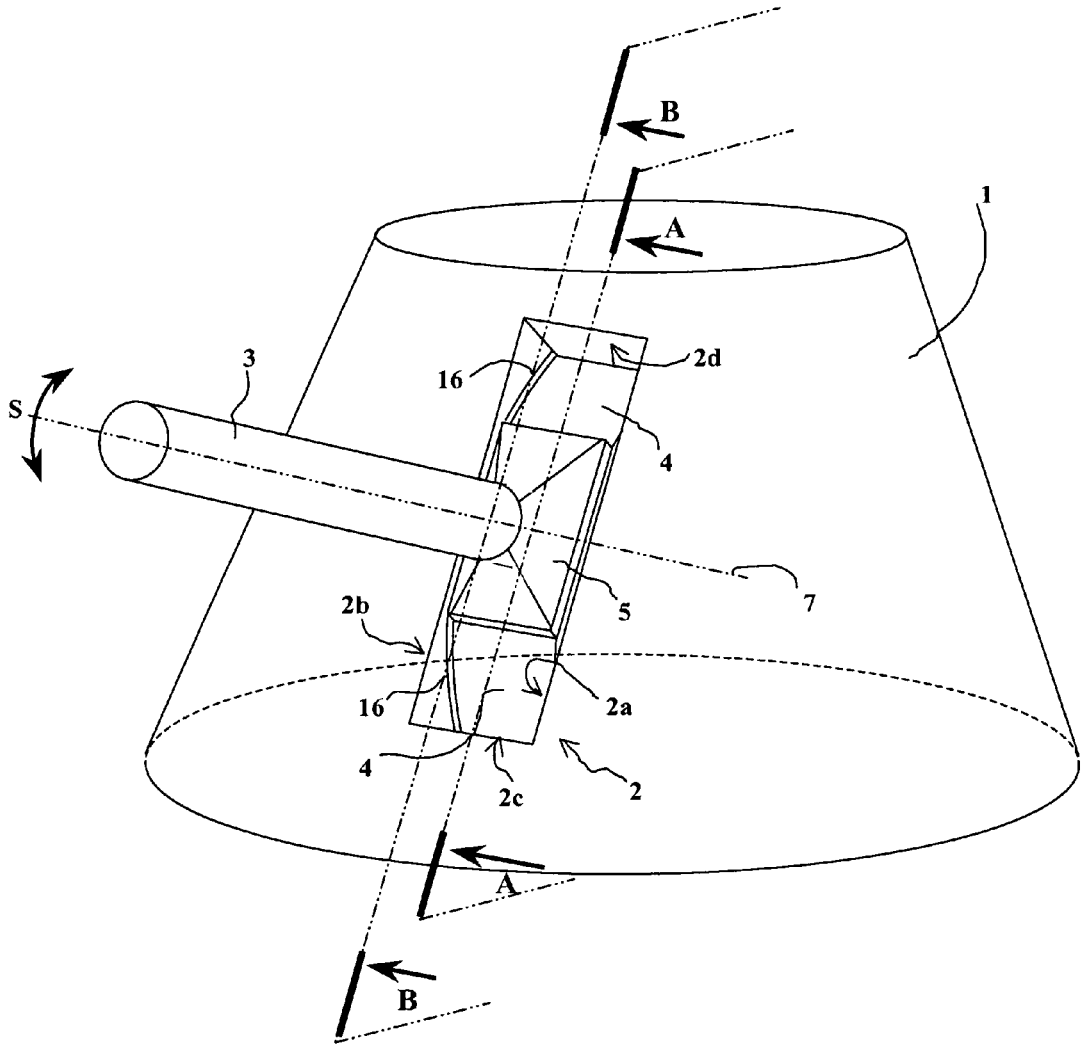
FIG. 1 is an extremely schematic view of a turret incorporating a gun slit in which a gun barrel pivots.

With reference to FIG. 1, a mount 1 which here is a turret, is mounted, for example, on an armoured vehicle (not shown), incorporates a substantially rectangular gun slit 2 delimited by two lateral flanges 2*a*, 2*b* and two end flanges 2*c* and 2*d*.

A mobile organ 3 (here a gun barrel) pivots in the gun slit 2 to enable the positioning in elevation of the weapon before firing (arrows).

Classically, the barrel 3 is integral with a mobile wall 4 which is cylindrical and which is guided on seats (not shown) integral with the turret 1.

This mobile wall 4 is to be positioned between the exterior and interior of the mount.

The invention is described with reference to a turret carrying a gun barrel that is able to pivot. The means presented in the invention are naturally not limited to the closing of a gun slit arranged in a turret.

The invention is applicable to any other type of mount in addition to a turret, for example a fixed mount such as a bunker carrying a gun barrel, or else to a mount for a machine tool. The pivoting or mobile organ may be something other than a gun barrel, for example an organ such as a control lever or handling means or a tool, and the movement of the organ may be a pivoting or translation with respect to the mount.

The barrel 3 is linked to the wall 4 by a shield 5 that is shown schematically in FIG. 1.

The device according to the invention incorporates two flexible bellows that are not shown in FIG. 1 (to enable the wall 4 to be seen). Each bellows is integral on one side with an end flange 2*c* or 2*d* of the gun slit 2 and on the other with the shield 5.

The bellows accompany the pivoting of the mobile organ and cover the wall 4 on either side of the shield 5 of the organ.

Figure 3:
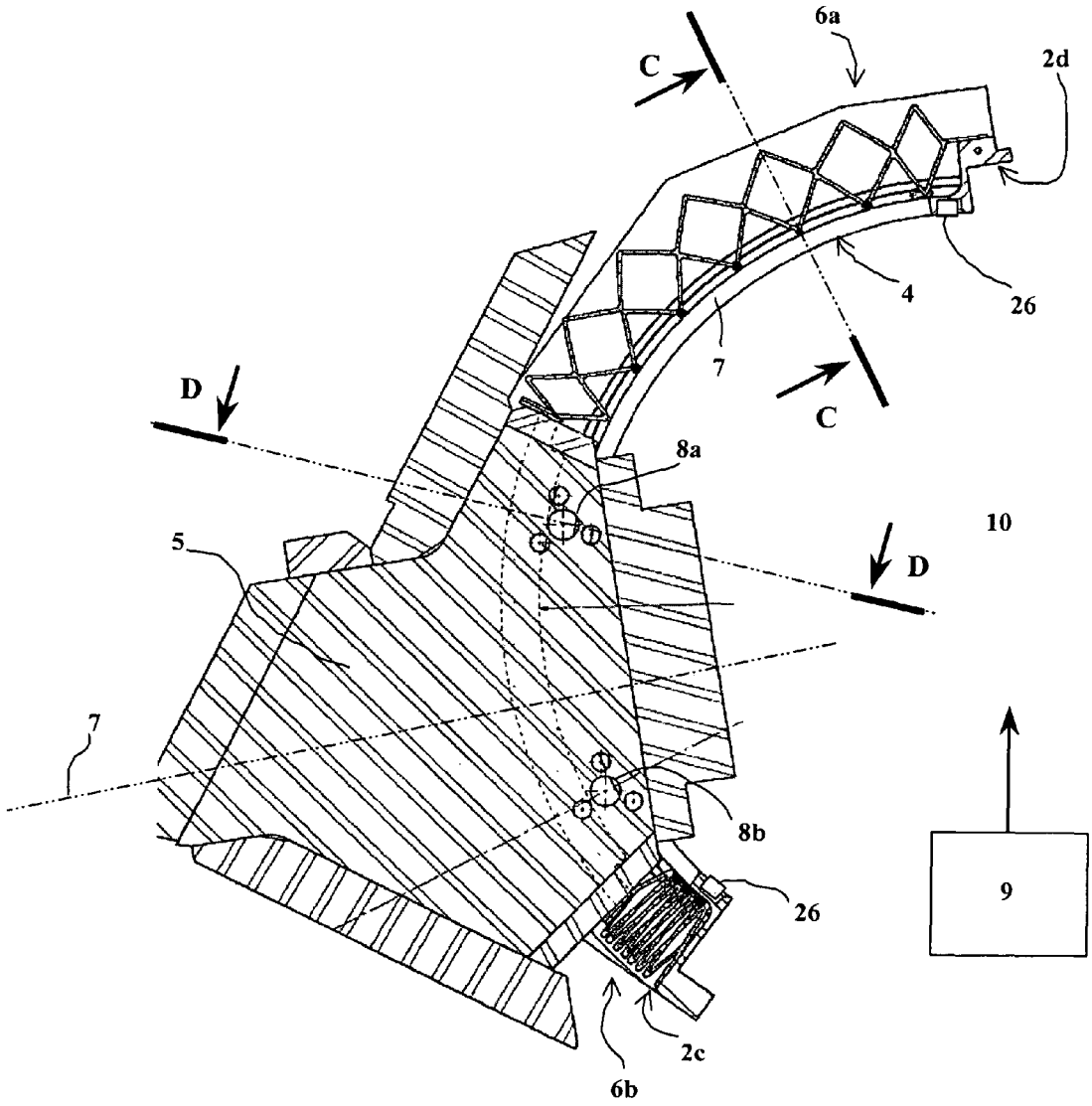
FIG. 3 is another partial section view of this turret, such section being made at the gun slit and along the plane referenced BB in FIG. 1, plane BB being parallel to plane AA.
Figure 6:
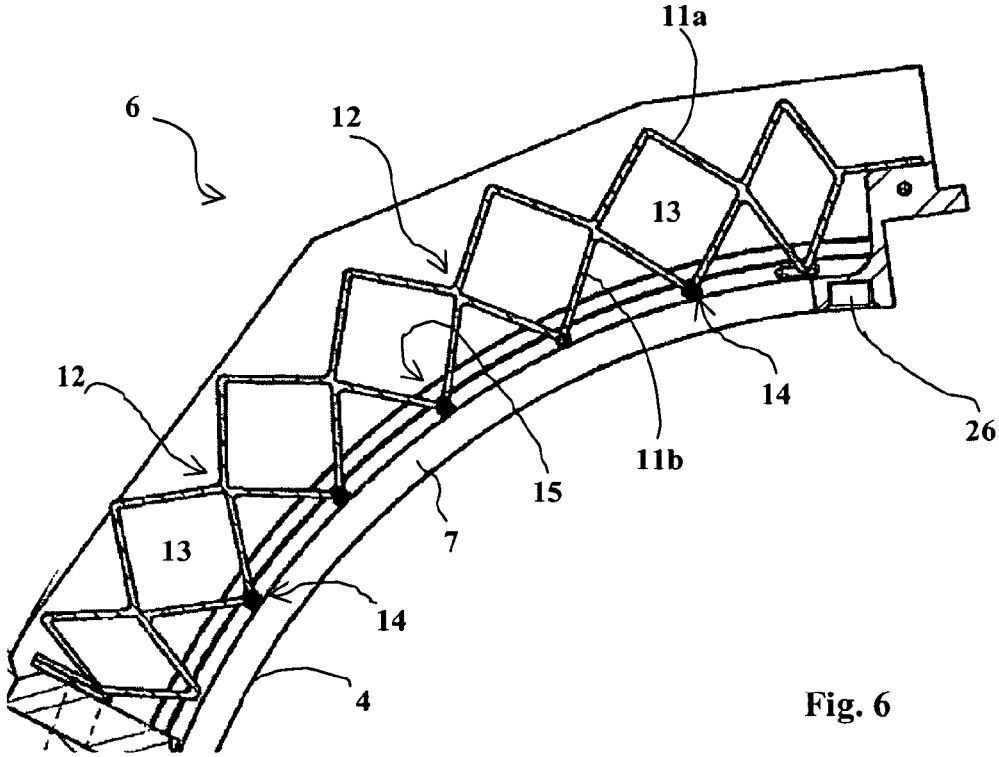
FIG. 6 is an enlarged cross section view of the bellows.
Figure 7:
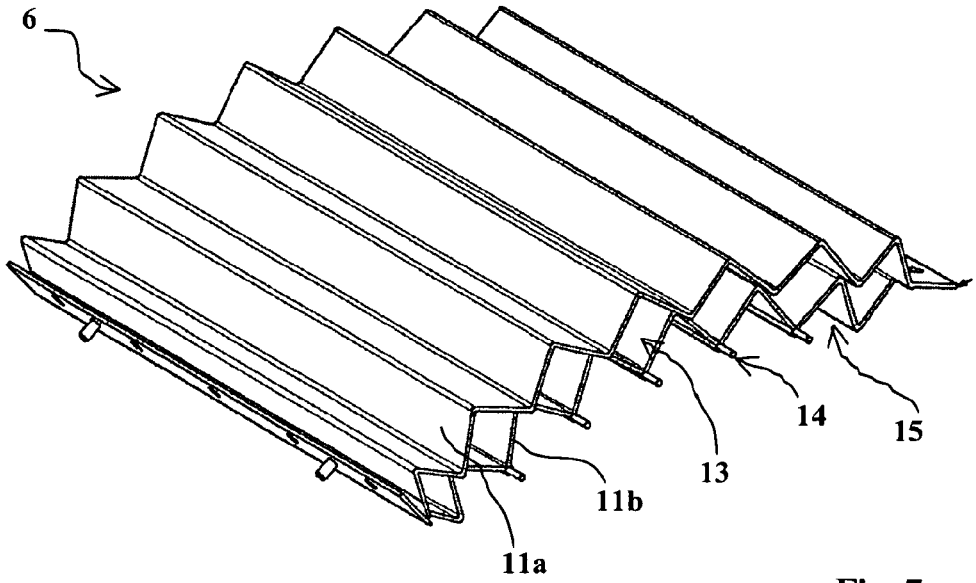
FIG. 7 is a perspective view of the bellows on its own.

FIGS. 3, 6 and 7 enable the structure of the bellows 6 (6*a*, 6*b*) to be more clearly seen.

In FIG. 3, the orientation of the gun barrel (not visible in this Figure) is shown by an axis 7. The barrel is oriented in this Figure with negative elevation. The upper bellows 6*a* is thus extended to its maximum capacity whereas the lower bellows 6*b* is compressed. FIGS. 3 and 6 show the arc of a circle delimiting the external contour of the wall 4 integral with the shield 5.

We observe that the bellows 6 and the wall 4 delimit an intermediate chamber 7. This chamber is linked to the internal space 10 of the turret by manifolds whose inlet openings 8 (8*a*, 8*b*) are referenced in FIG. 3.

Furthermore, the internal space 10 of the turret 1 is pressurised by pressurization means 9, for example a pump linked to the outside air by means of NBC filters specific to combat missions.

In its normal operating regime there is, therefore, a current of air escaping from the internal space 10 towards the intermediate chamber 7 and from the intermediate chamber 7 towards the exterior via the bellows 6*a*, 6*b*.

The pressure inside the internal space 10 is controlled by the pressurization means 9. The pressure in the intermediate chamber 7 will depend on the leakage section between the bellows 6 and flanges 2*a*/2*b* of the gun slit as well as the presence of any dynamic pressure (wind or vehicle movement) which may be added to the atmospheric pressure. The sealing mode of operation will be explained later.

FIGS. 3, 6 and 7 show that each flexible bellows (6*a*, 6*b*) incorporates two undulated layers 11*a*, 11*b* that are integral with one another by the peaks 12 of their undulations. The upper layer 11*a* is that which is in contact with the exterior air and the lower layer 11*b* is that which is positioned nearest to the mobile wall 4.

The two layers thus delimit transversal splines 13.

Furthermore, each bellows 6 incorporates rods 14 which are integral with its lower layer 11*b*.

The rods 14 are arranged at the peaks 15 of the lower layer 11*b* that are closest to the mobile wall 4.

The rods 14 circulate in guiding grooves 16 arranged on the lateral flanges 2*a*, 2*b* of the gun slit 2. The grooves 16 have been shown schematically in FIG. 1 and are also able to be seen in section view 4. The grooves 16 are circular in shape and are parallel to the cylindrical wall 4.

The bellows 6 will, for example, be made of an elastomer such as rubber. It will be advantageously produced by a single injection operation in the form of a single piece. It is also possible for two separate layers 11*a*, 11*b* to be made and joined together afterwards, for example by bonding or thermal welding.

The rods 14 will preferably be metallic and embedded by duplicate moulding into the lower layer 11*b*.

Figure 2:
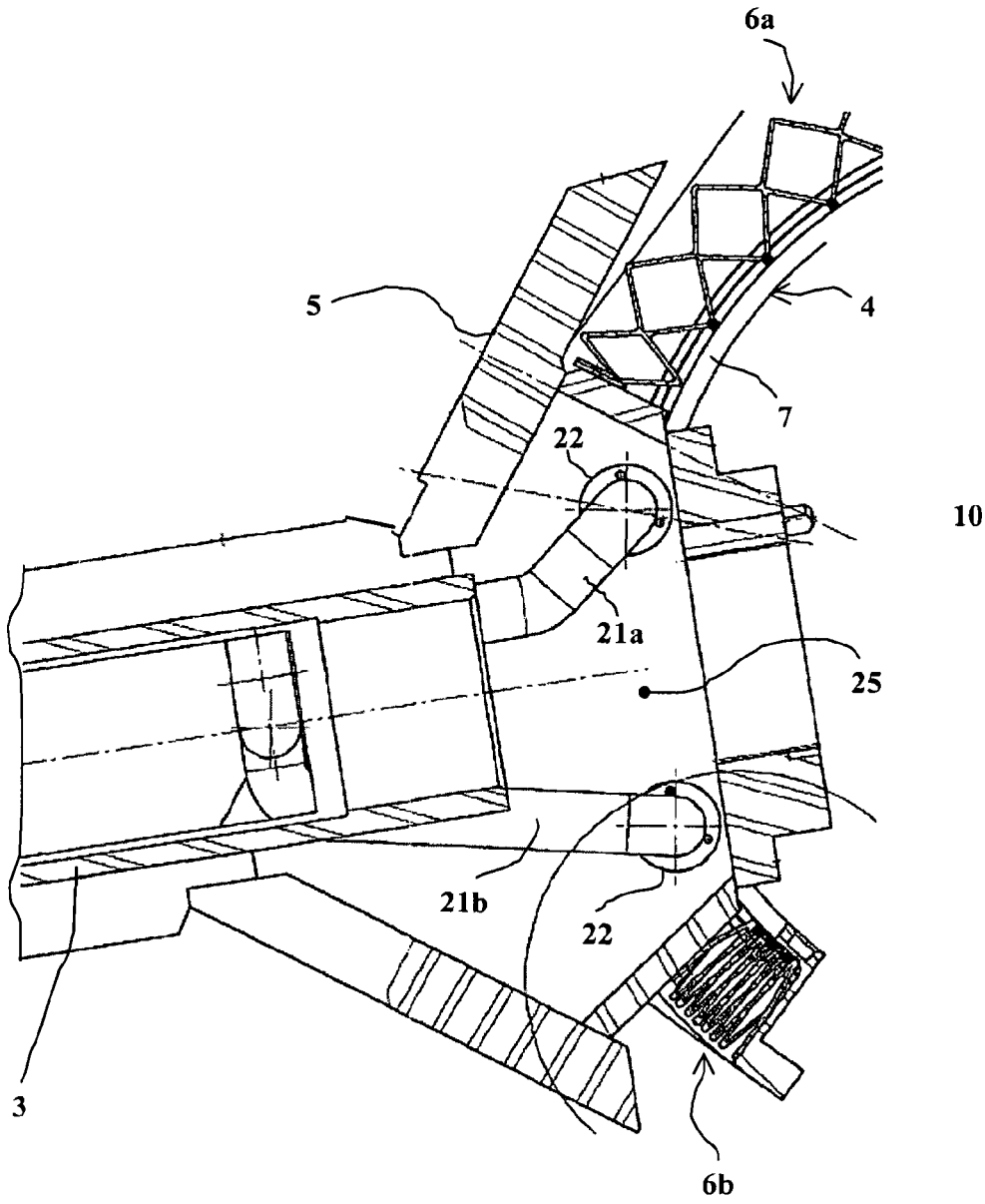
FIG. 2 is a partial section view of this turret, such section being made at the gun slit and along the plane marked AA in FIG. 1.

This bellows structure formed of two layers enables its rigidity to be improved whilst facilitating the compact compression of the bellows (see the bellows 6*b* shown compression in FIG. 2). Furthermore, the rods 14 constitute reinforcements to further improve the rigidity of the bellows 6.

The fact of arranging the rods at the peaks of the lower layer 11*b* also enables them to be positioned close to the wall 4. Any strain on the bellows is thus reduced. In fact, in the case of mechanical bending stresses on the bellows 6, the wall 4 constitutes a limit stop for the median part of the rods 14, thereby limiting their deformation and reinforcing the mechanical strength of the bellows.

It is thus possible for a man to walk on one of the bellows without deteriorating it.

Lastly, thanks to the grooves 16, the rods guide the bellows 6 during the pivoting of the gun barrel 3 and this despite the elongation shape of the gun slit 2 and the high clearance angle for the barrel 3 (over 45°).

Figure 4:
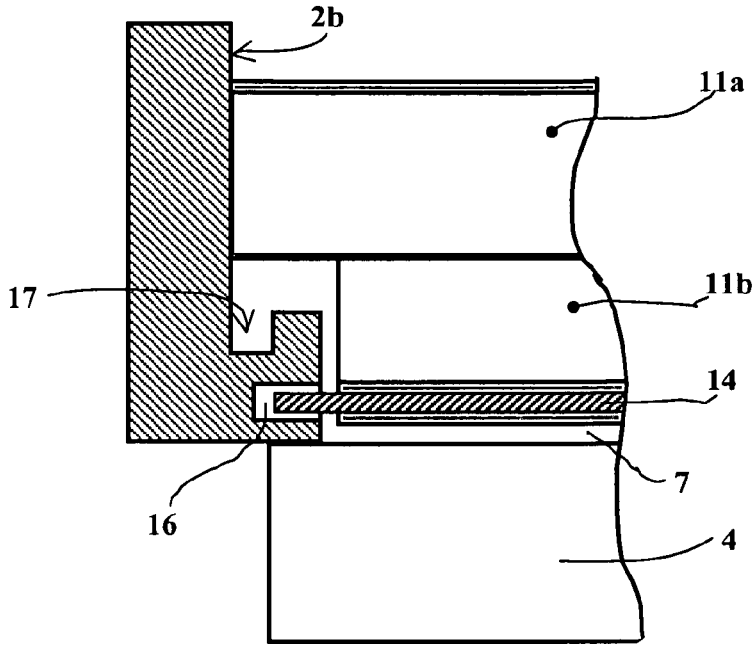
FIG. 4 is a partial section view showing how the bellows cooperates with the lateral flanges of the gun slit, the section being made along the plane reference CC in FIG. 3.

According to another characteristic of the invention that can be seen more particularly in FIG. 4, the upper layer 11*a* of the bellows 6 is of a width that is greater than that of the lower layer 11*b*.

We can thus observe that the upper layer 11*a* rubs on the lateral flanges 2*b*, 2*c* of the gun slit 2 when the organ is being displaced whereas the lower layer 11*b* is located at a distance from these flanges. Such an arrangement enables friction during the pivoting of the gun 3 to be reduced.

FIG. 4 also shows that the lateral flanges 2*b* (and 2*a*) each carry a gutter 17 arranged between the upper layer 11*a* and the guiding groove 16.

Each gutter 17 is thus positioned facing the contact surface between the upper layer 11*a* and the lateral flange 2*a* or 2*b* in question.

The gutters are linked to means to evacuate run-off water (not shown), for example a duct which is oriented to the exterior of the turret 1.

Figure 5:
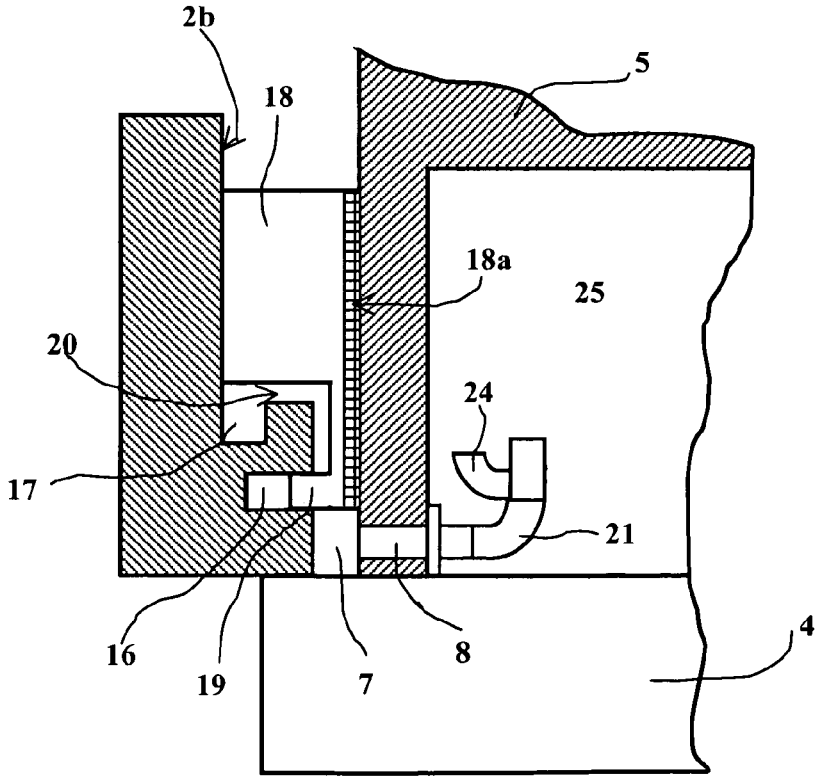
FIG. 5 is a partial section view showing how the mobile organ itself cooperates with the lateral flanges of the gun slit, the section being made along the plane reference DD in FIG. 3.

FIG. 5 shows a section made at the shield 5.

This section enables the means to be visualised that enable the sealing to be completed. In fact, the bellows 6*a* and 6*b* ensure the sealing between the barrel and the end flanges 2*c* and 2*d* of the gun slit 2. This sealing has to be completed by means to ensure tightness between the mobile organ 3 itself and the lateral flanges 2*a* and 2*b* of the gun slit 2.

These means incorporate two lateral shims 18 made integral with the organ 3 (or more particularly with the shield 5). The shims 18 here are guided by a groove 16 and are simply immobilised by the bellows 6. Such an arrangement enables assembly and disassembly (removal of the gun slit seal support being possible without the shield having to be removed). Other ways of mounting the shims 18 may be envisaged, such as, for example, assembly by screws. Each shim 18 is positioned between the shield 5 and one of the lateral flanges 2*a* or 2*b*. Here, a single shim is shown.

Figure 9:
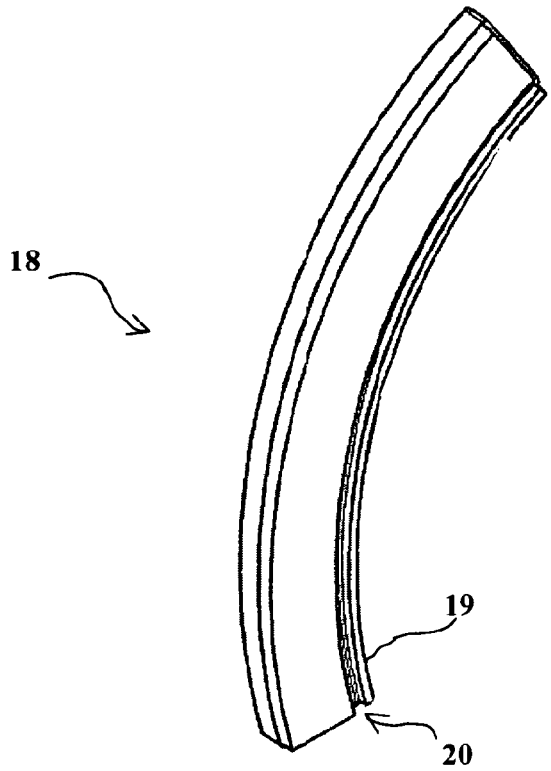
FIG. 9 is a perspective view of one of the lateral shims positioned between the mobile organ and the lateral flanges of the gun slit.

Each shim 18 incorporates a profile that cooperates with the guiding groove 16. This profile here comprises a jaw 19 delimiting a notch 20 capping the gutter 17. The jaw 19 is introduced into the groove 16. FIG. 9 thus shows a shim 18 on its own. The shim 18 is in the shape of an arc of a circle and extends over the full width of the shield 5.

When the gun 3 pivots, the shim slips on the lateral flange in question (2*a* or 2*b*). It fills all the space separating the shield 5 and the flange 2*a*, 2*b* and the jaw 19 slides in the groove 16. The shim 18 is intended to limit the leakage sections between the shield 5 and the flanges 2*a*/2*b* of the gun slit. The jaw 19 further ensures that the groove 16 is kept clean.

Any running water is directly evacuated by the gutter 17. The shims 18 will be made of a material that reduces friction, for example a polytetrafluorethylene (known under the trade name Teflon). Additionally, each shim will incorporate a layer 18*a* of honeycomb material (for example synthetic closed cell foam) or else a rubber seal. This deformable layer is positioned between the shim 18 and the shield 5. It enables any dispersion in the assembly dimensions to be compensated for and ensures that the shim 18 is held firmly against the flange 2*a*, 2*b* in question.

As seen previously (with reference to FIG. 3), the openings 8 enable the intermediate chamber 7 to be connected to the internal space 10 of the turret 1.

In practical terms, the device comprises two openings 8, an upper opening 8*a* linked to the intermediate chamber 7 delimited by the upper bellows 6*a* and a lower opening 8*b* linked to the intermediate chamber 7 delimited by the lower bellows 6*b*.

These openings each communicate with a manifold 21 (21*a* or 21*b*) which is linked to the shield by a flange 22.

Figure 8:
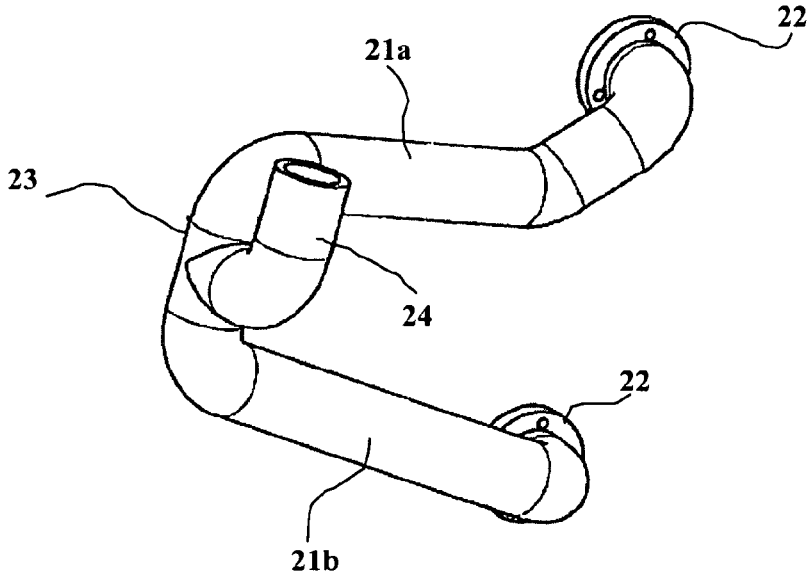
FIG. 8 is a detailed view showing the isolated manifold linking the intermediate chamber to the internal space of the mount.

FIG. 2 enables these manifolds 21*a* and 21*b* to be visualised. They are connected to one another at a distance from openings 8 by a linking branch 23. FIG. 8 more clearly shows the assembly of the manifolds. An air inlet manifold 24 is linked to the linking branch 23. As can be seen in FIGS. 2 and 5, this manifold opens into a chamber 25, internal to the shield 5 and arranged laterally to the gun barrel 3, such chamber 25 communicating with the internal space 10 of the turret 1.

The different curves of the manifolds 21, 23, 24 constitute a baffle that prevents the passage of run-off liquid (mainly water or decontamination liquids) from the intermediate chamber 7 to the internal space 10.

If a liquid that has not been evacuated by the gutters 17 were to reach the intermediate chamber 7 and pass through one of the openings 8 it would therefore be trapped in the manifolds whose lengths and shapes are chosen so as to prevent this liquid from passing into the internal space 10.

Sealing is further completed by the insertion of a seal 26 positioned between the edges of the gun slit 2 and the wall 4 (see FIGS. 3 and 6). The seal is globally substantially rectangular in shape. It follows the profile of the gun slit 2 and remains in contact with the wall 4 when the latter is pivoting. This seal enables the intermediate chamber 7 to be separated from the internal space 10 in the turret 1. It prevents any passage of liquid from the intermediate chamber 7 to the internal space 10.

The protection device operates as follows.

In its normal operating mode, the air is over-pressured inside the internal space 10 of the turret. The level of this pressure is adjusted and maintained substantially constant by the pressurization means 9. This pressure level is of around 1200 to 1600 Pa above the pressure level outside the turret.

The over-pressured air passes by manifolds 24, 23, 21 and establishes an overpressure in the two intermediate chambers 7 (one per bellows 6). The air escapes via the leakage spaces separating the edges of the bellows and the lateral flanges of the gun slit 2.

The sealing operates as follows:

The case for a gas.

The contaminated gas is not able to penetrate into the intermediate chambers 7. In fact, these chambers are in overpressure with respect to the exterior of the turret (in the limit of a face wind and a specific speed defined during design). The air flow is thus outwards and it prevents any polluted gas from penetrating into the intermediate chambers 7.

When the gas is projected towards the bellows 6 (for example when there is a face wind or as the vehicle is travelling), the pressure, in the intermediate chambers 7 is balanced at an intermediate level between the exterior pressure and the pressure in the internal space 10. The air flow is once again in an outward direction from the intermediate chambers 7 towards the exterior (in the limits of the face wind and speed having already been specified).

This particularity of the invention, enables the leakage section to be restricted between the internal space 10 and the exterior to the value of the openings 8*a*, 8*b* for the linkage of the manifolds (whereas the theoretical bellows 6/gun slit 2 leakage section may be greater).

The case for a liquid.

If a liquid is able to penetrate into one of chambers 7, it is not able to reach the internal space 10. Indeed, if liquid penetrates the leakage spaces between the bellows and lateral flanges of the gun slits, it is mostly collected by the gutters 17. If a small part of this liquid reaches one of the intermediates chambers 7 it is trapped by the manifolds 21, 23, 24 which link these chambers to the internal volume of the turret. The gun slit seal 26 further completes sealing also preventing any passage of liquid. The protection provided is thus optimal.

Naturally, the invention thus described in its application to the protection of a gun slit in the turret of an armoured vehicle may be extended to the protection of an opening for any other type of equipment, for example a machine tool or construction machinery.

What is claimed is:

1. A protection device for closing a gun slit of a mount, the gun slit delimited by two lateral flanges and two end flanges and in which pivots or moves a mobile organ carrying a mobile wall positioned between an exterior and an interior of the mount, the protection device comprising:

at least one flexible bellows configured to be integral with one of the end flanges on one side of the flexible bellows and integral with the mobile, organ on another side of the flexible bellows, wherein the bellows and the mobile wall are configured to delimit an intermediate chamber that is linked to an internal pressurized space of the mount.

2. A protection device according to claim 1, wherein the flexible bellows includes two undulated upper and lower layers integral with one another by peaks of their undulations so as to delimit transversal splines between the two layers.

3. A protection device according to claim 2, wherein the bellows includes rods that are integral with the lower layer and positioned as closely as possible to the mobile wall at the peaks of the lower layer that are closest to the mobile wall and guiding grooves arranged on the flanges of the gun slit and in which the rods circulate.

4. A protection device according to claim 2, wherein the upper layer has a width that is greater than a width of the lower layer, and the upper layer rubs against the lateral flanges of the gun slit when the organ is being displaced.

5. A protection device according to claim 3, wherein the lateral flanges each include a gutter positioned between the upper layer and one of the guiding grooves and being linked to means to evacuate run-off water.

6. A protection device according to claim 1, wherein the intermediate chamber is linked to the internal space of the mount by a manifold incorporating at least one baffle to prevent the run-off water from passing from the intermediate chamber to the internal space.

7. A protection device according to claim 3, further comprising lateral shims that ensure sealing between the mobile organ and the lateral flanges of the gun slit, the lateral shims being integral with the organ and positioned between the organ and one of the lateral flanges.

8. A protection device according to claim 7, wherein the shims have a profile that cooperates with the guiding groove.

9. A protection device according to claim 5, wherein the intermediate chamber is linked to the internal space of the mount by a manifold incorporating at least one baffle to prevent the run-off water from passing from the intermediate chamber to the internal space.

10. A protection device according to claim 1, further comprising lateral shims that ensure sealing between the mobile organ and the lateral flanges of the gun slit, the lateral shims being integral with the organ and positioned between the organ and one of the lateral flanges.

* * * * *